US007710229B2

(12) United States Patent
Inagaki

(10) Patent No.: US 7,710,229 B2
(45) Date of Patent: May 4, 2010

(54) IGNITION COIL AND IGNITION COIL SYSTEM HAVING THE SAME

(75) Inventor: Masahiro Inagaki, Chiryu (JP)

(73) Assignee: Denso Corporation, Kariya (JP)

( * ) Notice: Subject to any disclaimer, the term of this patent is extended or adjusted under 35 U.S.C. 154(b) by 506 days.

(21) Appl. No.: 11/822,483

(22) Filed: Jul. 6, 2007

(65) Prior Publication Data

US 2008/0007379 A1 Jan. 10, 2008

(30) Foreign Application Priority Data

Jul. 6, 2006 (JP) ..... 2006-186900

(51) Int. Cl.
*H01F 27/02* (2006.01)
*H01F 38/12* (2006.01)
*F02P 3/02* (2006.01)

(52) U.S. Cl. ..... 336/90; 123/634; 123/635

(58) Field of Classification Search ..... 336/90–96, 336/107, 192; 123/634–635
See application file for complete search history.

(56) References Cited

U.S. PATENT DOCUMENTS 5,866,808 A * 2/1999 Ooyabu et al. ..... 73/114.08
5,979,406 A * 11/1999 Aoki et al. ..... 123/406.37
6,049,176 A * 4/2000 Aoki et al. ..... 315/209 M
6,348,797 B1 2/2002 Shimizu et al.
2002/0033041 A1 * 3/2002 Yamada et al. ..... 73/35.01
2003/0098764 A1 * 5/2003 Wada ..... 336/96
2004/0231652 A1 * 11/2004 Kondo et al. ..... 123/634

FOREIGN PATENT DOCUMENTS

JP 3028977 7/1996

* cited by examiner

*Primary Examiner*—Elvin G Enad
*Assistant Examiner*—Tszfung Chan
(74) *Attorney, Agent, or Firm*—Nixon & Vanderhye

(57) ABSTRACT

An ignition coil includes primary and secondary coils, center and outer cores, and an ion current detector for transmitting an ion current detection output. The center core has an axial upper end defining a center core upper end surface. The outer core has an axial upper end defining an outer core upper end surface. The center core upper end surface axially protrudes upwardly relative to the outer core upper end surface. The center core upper end surface is located at a stagger distance axially from the outer core upper end surface. The stagger distance is defined such that a detection period for residual magnetic noise in the ion current detection output falls within a system requirement period of a control unit.

16 Claims, 7 Drawing Sheets

IGNITION COIL AND IGNITION COIL SYSTEM HAVING THE SAME

CROSS REFERENCE TO RELATED APPLICATIONS

This application is based on and incorporates herein by reference Japanese Patent Application No. 2006-186900 filed on Jul. 6, 2006.

FIELD OF THE INVENTION

The present invention relates to an ignition coil having an ion current detector. The present invention relates to an ignition coil system having the ignition coil.

BACKGROUND OF THE INVENTION

An ignition coil provided with a sparkplug is mounted to an engine of a vehicle. The sparkplug generates spark to ignite mixture of fuel and air in each cylinder of the engine. When the mixture is burned in the cylinder, fuel contained in the mixture is ionized, so that an ion current flows between a pair of electrodes provided to the sparkplug. An ion current detector is provided to such an ignition coil to detect an ion current for monitoring misfire in the cylinder.

The ignition coil generates therein an inductive magnetic field by terminating electricity supplied to a primary coil of the ignition coil. The inductive magnetic field generates induced electromotive force in a secondary coil of the ignition oil, so that the pair of electrodes of the sparkplug generates spark. Immediately after generating the spark by forming the inductive magnetic field, residual magnetism remains in the ignition oil. The ion current detector may falsely detect noise, which is caused by the residual magnetism, as the ion current. Accordingly, the ion current detector detects the ion current by waiting a predetermined period after generating the spark.

According to U.S. Pat. No. 5,866,808 (JP-A-H9-195913), the ion current detector has a structure capable of stably detecting the ion current by reducing residual magnetism. Furthermore, according to the ignition coil in JP-U-3028977, the cross section of the outer core is set to be in a range between 75% and 100% of the cross section of the center core, thereby enhancing ignition energy of the ignition coil.

However, the above conventional structure of each ignition coil is not sufficient to stabilize detection of the ion current. Specifically, in the above conventional structure of each ignition coil, a relationship between axial end surfaces of the center core and the outer core on the axially opposite side of the spark plug is not considered. Accordingly, the above conventional structure is not sufficient to enhance accuracy in the detection of the ion current.

SUMMARY OF THE INVENTION

The present invention addresses the above disadvantage. According to one aspect of the present invention, an ignition coil for a sparkplug having electrodes, the ignition coil adapted to being electrically connected with a control unit, the ignition coil including primary and secondary coils each having an axial high voltage end adapted to connecting with the sparkplug. The ignition coil further includes an ion current detector for detecting an ion current flowing through the electrodes. The ignition coil further includes a center core provided on a radially inner side of the primary and secondary coils. The center core is formed of a magnetic material. The ignition coil further includes an outer core provided on a radially outer side of the primary and secondary coils. The outer core is formed of a magnetic material. The center core has an axial low voltage end defining a center low end surface. The outer core has an axial low voltage end defining an outer low end surface. The center low end surface axially protrudes toward an opposite side of the axial high voltage end relative to the outer low end surface. The center low end surface is located at a stagger distance from the outer low end surface with respect to an axial direction of the center core. The stagger distance is defined such that a detection period correlated to residual magnetic noise in the ion current detection output of the ion current detector is within a system requirement period of the control unit.

According to another aspect of the present invention, an ignition coil for a sparkplug having electrodes, the ignition coil including primary and secondary coils each having an axial high voltage end connectable with the sparkplug. The ignition coil further includes an ion current detector for detecting an ion current flowing through the electrodes. The ignition coil further includes a center core provided on a radially inner side of the primary and secondary coils. The center core is formed of a magnetic material. The ignition coil further includes an outer core provided on a radially outer side of the primary and secondary coils. The outer core is formed of a magnetic material. The center core has an axial low voltage end defining a center low end surface. The outer core has an axial low voltage end defining an outer low end surface. The center low end surface axially protrudes toward an opposite side of the axial high voltage end relative to the outer low end surface. The center low end surface is located at a stagger distance from the outer low end surface with respect to an axial direction. The stagger distance is equal to or greater than 3 mm, and is equal to or less than 12.5 mm. The center core has a center-core cross section perpendicularly to the axial direction. The outer core has an outer-core cross section perpendicularly to the axial direction. The center-core cross section and the outer-core cross section are in an outer-to-center cross-section ratio. The outer-to-center cross-section ratio is equal to or greater than 54.3, in a structure in which the stagger distance is equal to or greater than 3 mm and equal to or less than 6 mm. The outer-to-center cross-section ratio is equal to or greater than 7.11×(stagger distance−6)+54.3, in a structure in which the stagger distance is greater than 6 mm and equal to or less than 12.5 mm.

According to another aspect of the present invention, an ignition coil system for a sparkplug having electrodes, the ignition coil system including a control unit. The ignition coil system further includes an ignition coil electrically connected with the control unit. The ignition coil includes primary and secondary coils each having an axial high voltage end adapted to connecting with the sparkplug. The ignition coil further includes an ion current detector for detecting an ion current flowing through the electrodes and transmitting an ion current detection output. The ignition coil further includes a center core provided on a radially inner side of the primary and secondary coils. The center core is formed of a magnetic material. The ignition coil further includes an outer core provided on a radially outer side of the primary and secondary coils. The outer core is formed of a magnetic material. The center core has an axial low voltage end defining a center low end surface. The outer core has an axial low voltage end defining an outer low end surface. The center low end surface axially protrudes toward an opposite side of the axial high voltage end relative to the outer low end surface. The center low end surface is located at a stagger distance from the outer low end surface with respect to an axial direction of the center core. The stagger distance is defined such that a duration period of at least one of a plurality of waves indicating residual magnetic noise in the ion current detection output is within a system requirement period of the control unit.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
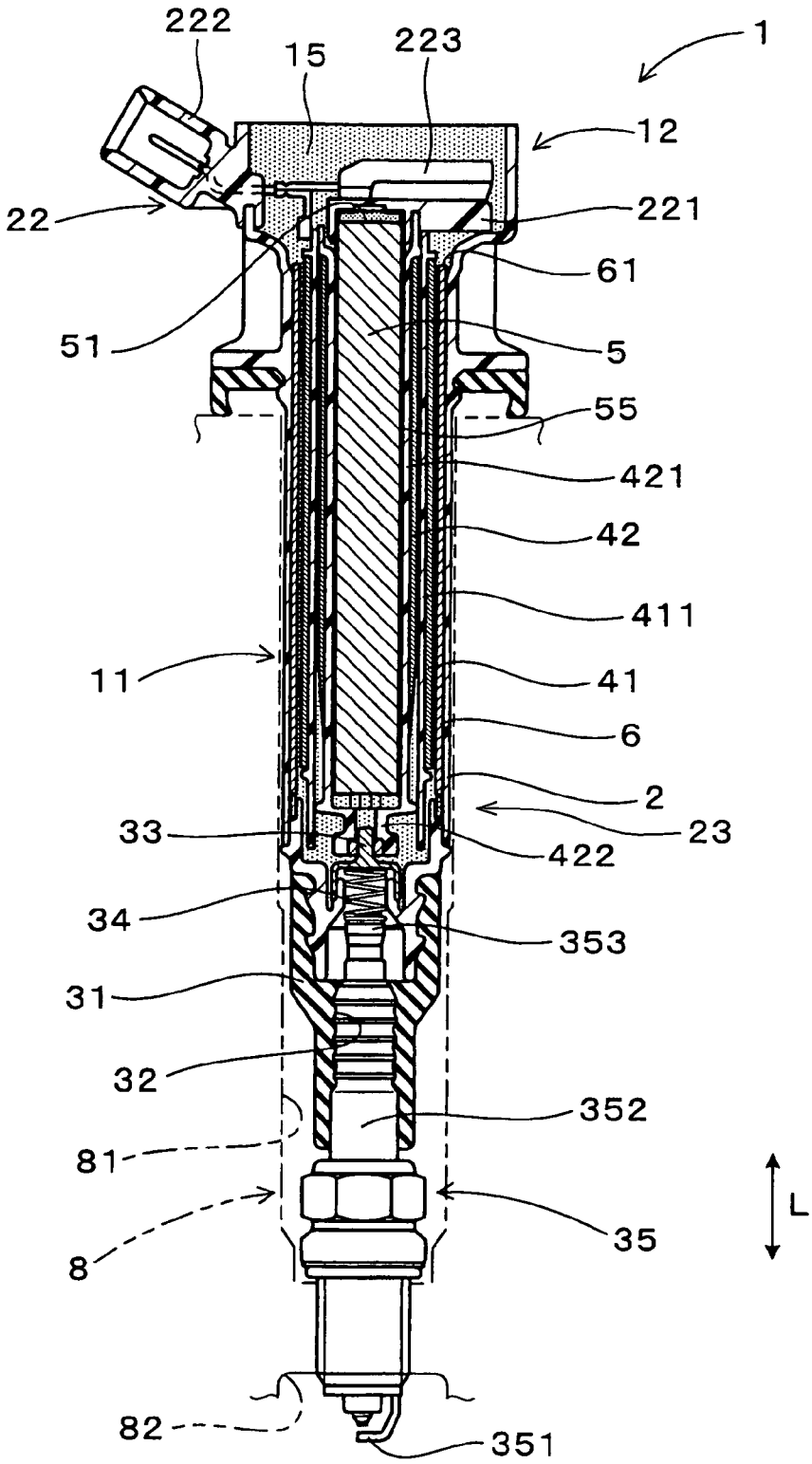
FIG. 1 is a sectional view showing an ignition coil according to a first embodiment.

As follows, an ignition coil 1 is described with reference to FIG. 1. In this embodiment, as shown in FIG. 1, the ignition coil 1 includes a primary coil 41 and a secondary coil 42. Each of the primary coil 41 and the secondary coil 42 has an axial lower end (axial high voltage end) with respect to an axial direction L in FIG. 1. The lower end is provided with a sparkplug 35 including a pair of electrodes 351. The sparkplug 35 further includes an ion current detector for detecting an ion current flowing between the electrodes 351. A center core 5 is provided on the radially inner side of the primary coil 41 and the secondary coil 42. The center core 5 is formed of a magnetic material. An outer core 6 is provided on the radially outer side of the primary coil 41 and the secondary coil 42. The outer core 6 is formed of a magnetic material.

Figure 2:
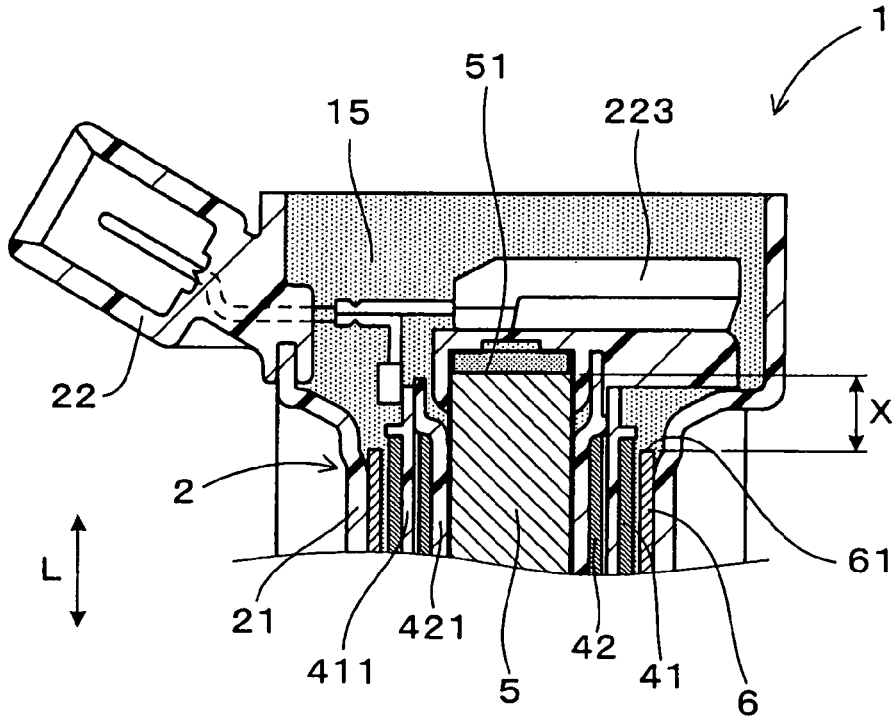
FIG. 2 is a sectional view showing a connector portion of the ignition coil according to the first embodiment.

As shown in FIG. 2, the center core 5 has an axial upper end (axial low voltage end) defining an upper end surface defining a center core upper end surface (center low end surface) 51 with respect to the axial direction L. The outer core 6 has an upper end surface defining an outer core upper end surface (outer low end surface) 61 with respect to the axial direction L. The center core upper end surface 51 upwardly protrudes relative to the outer core upper end surface 61 axially toward a low voltage side on the upper side in FIG. 1, i.e., toward an opposite side of the axial high voltage ends of the primary coil 41 and the secondary coil 42.

In this ignition coil 1, the center core upper end surface 51 is distant from the outer core upper end surface 61 by a stagger distance X with respect to the axial direction L. The stagger distance X is defined such that a detection period for residual magnetic noise in the ion current detection output of the ion current detector falls within a system requirement period of an engine control unit (ECU). The ECU is an electronic control unit for an engine 8.

As follows, the ignition coil 1 is described with reference to FIGS. 1 to 7. As shown in FIG. 1, the primary coil 41 is constructed by winding a primary wire, which is applied with an insulative coating, around the outer circumferential periphery of a primary spool 411 for a primary winding number. The secondary coil 42 is constructed by winding a secondary wire, which is applied with an insulative coating, around the outer circumferential periphery of a secondary spool 421 for a secondary winding number, which is greater than the primary winding number. The secondary coil 42 is arranged on the radially inner side of the primary coil 41. The center core 5 is arranged on the radially inner side of the secondary coil 42. The outer core 6 is provided on the radially outer side of the primary coil 41. The outer core 6 is inserted through a coil case 2, which is a cylindrical resin member. Thus, a coil main body 11 is constructed by accommodating the primary coil 41, the secondary coil 42, the center core 5, the outer core 6, and the like in the coil case 2.

The center core 5 is constructed by stacking substantially flat electromagnetic steel plates perpendicularly to the axial direction L of the ignition coil 1. The substantially flat electromagnetic steel plates are, for example, silicon steel plates each applied with an electrically insulative coating. The outer core 6 is constructed of multiple substantially cylindrical electromagnetic steel plates such as silicon steel plates having at least one silt (gap) with respect to the axial direction L. The electromagnetic steel plates are stacked with respect to the radial direction to construct the outer core 6. The center core 5 and the outer core 6 define therebetween a magnetic path (magnetic circuit) through which magnetic flux is formed by supplying electricity to the primary coil 41. An insulative tape 55 is wound around the outer circumferential periphery of the center core 5 for relaxation of stress.

The upper ends of the primary coil 41 and the secondary coil 42 with respect to the axial direction L are provided with a connector portion 12 for electrically connecting the ignition coil 1 with the engine ECU. The coil case 2 is constructed of a case main body 21, a connector case 22, and a plug case 23. The case main body 21 accommodates the primary coil 41, the secondary coil 42, the center core 5, the outer core 6, and the like The connector case 22 is connected with the upper end of the case main body 21 with respect to the axial direction L. The plug case 23 is connected with the lower end of the case main body 21 with respect to the axial direction L. Each of the case main body 21, the connector case 22, and the plug case 23 is formed of resin.

The connector case 22 includes a mount portion 221 and a connector portion 222. The mount portion 221 is provided with an igniter 223 having an electric power circuit and the like for controlling the ignition coil 1. The connector portion 222 electrically connects the igniter 223 with the engine ECU. The connector portion 222 is integrated with a plus-power pin, a minus-power pin, a plus-spark signal pin, a minus-spark signal pin, and the like by, for example, insert-molding. Each pin of the connector portion 222 is connected with corresponding pin of the igniter 223.

Figure 3:
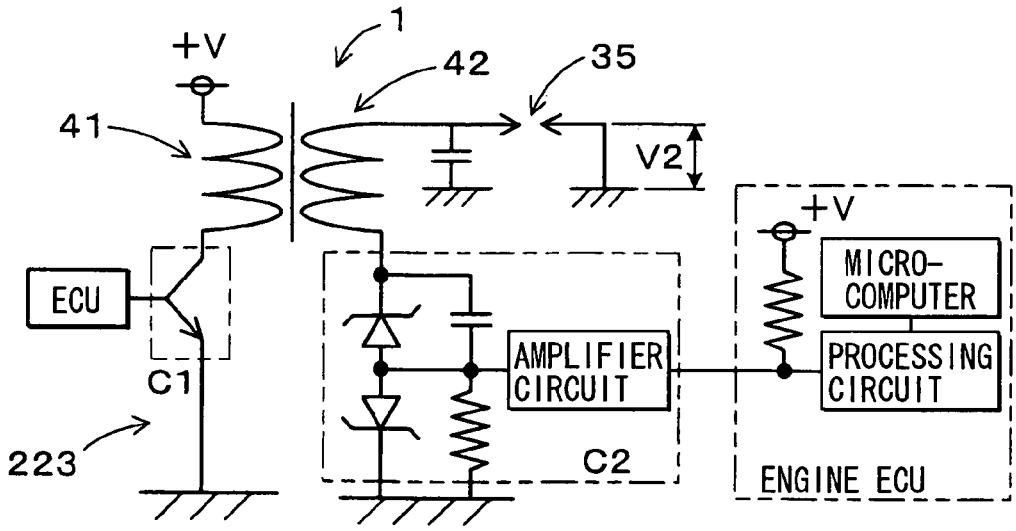
FIG. 3 is a schematic view showing an ion current detection circuit of the ignition coil, according to the first embodiment.

As shown in FIG. 3, the igniter 223 includes a power control circuit C1 and an ion current detection circuit C2. The power control circuit C1 supplies electricity to the primary coil 41 by receiving a signal from, for example, the ECU. The ion current detection circuit C2 detects the ion current passing between the pair of electrodes 351 of the sparkplug 35. The ion current detector of the ignition coil 1 is constructed of the ion current detection circuit C2 in the igniter 223.

The ion current detection circuit C2 includes an amplifier circuit for amplifying the detection signal of the ion current.

Referring to FIG. 1, the plug case 23 is provided with a plug cap 31 formed of rubber for electrically insulating the ignition coil 1 and protecting the ignition coil 1 against water intrusion. An insulator 352 of the sparkplug 35 is fitted into a plug fitting hole 32 of the plug cap 31. The lower end of the secondary spool 421 with respect to the axial direction L extends to define an extended portion 422. A high voltage terminal 33 is provided in the extended portion 422 on the radially inner side of the plug case 23. The high voltage terminal 33 is electrically conductive with a high voltage winding end of the secondary coil 42. The high voltage terminal 33 is provided with a coil spring 34 conductive with a terminal portion 353 of the sparkplug 35.

The ignition coil 1 has a stick-type structure. Specifically, the lower end of the coil main body 11 with respect to the axial direction L is inserted into a plughole 81 of a cylinder head cover of the engine 8, together with the sparkplug 35. The connector portion 12 provided with the igniter 223 and the upper end of the coil main body 11 with respect to the axial direction L are located outside the plughole 81. The sparkplug 35 mounted to the ignition coil 1 is screwed with a bottom portion of the plughole 81. The pair of the electrodes 351 of the sparkplug 35 protrudes into a corresponding combustion chamber 82 of the engine 8. Each gap in the coil case 2 is charged with electrically insulative resin 15 such as epoxy resin. Specifically, a gap surrounded with the coil main body 11, the connector case 22, and the plug case 23 is are charged with the electrically insulative resin 15.

Figure 4:
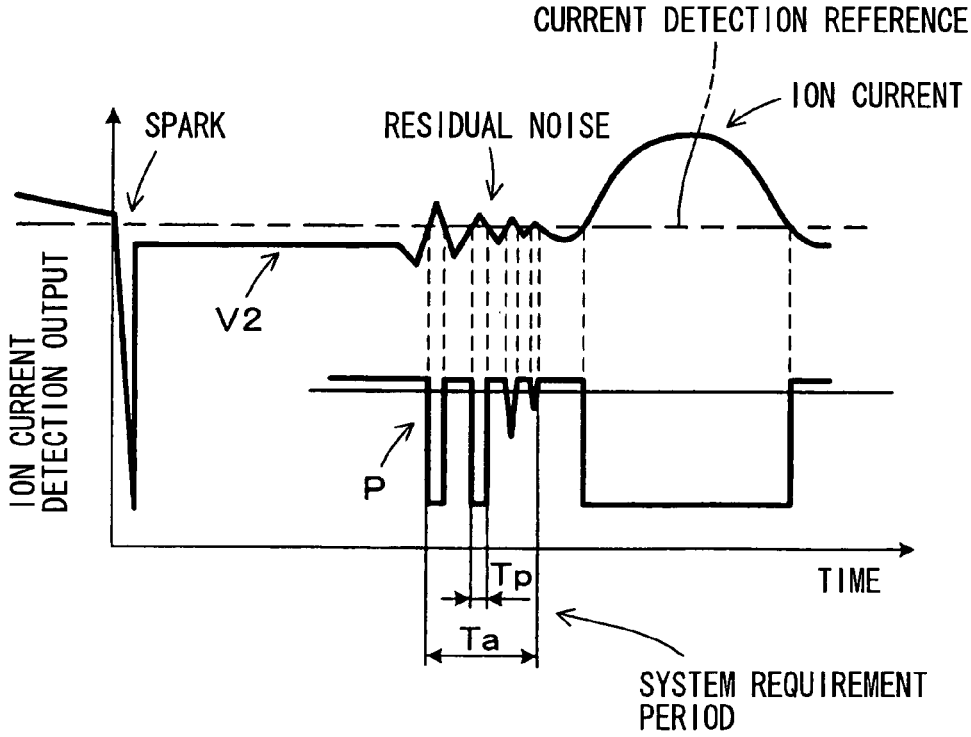
FIG. 4 is a time chart showing an output of the ion current detection circuit.

As shown in FIG. 3, a voltage signal V2 is obtained from electricity flowing in the secondary coil 42 through the pair of electrodes 351 of the sparkplug 35. As shown in FIG. 4, the ion current detection output is obtained as a pulse signal P by performing a digital processing to the voltage signal V2.

Figure 5:
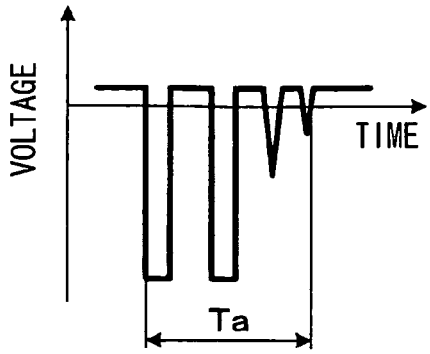
FIGS. 5, 6 are time charts showing residual magnetic noise.
Figure 6:
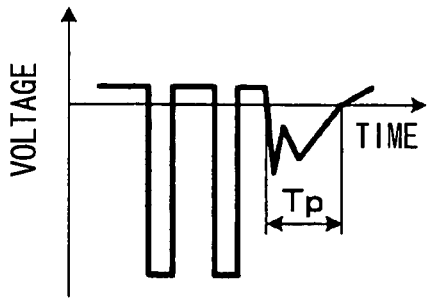

As shown in FIG. 5, the total residual magnetic noise falsely appears as a pulse-voltage signal in the ion current detection output for a total duration Ta. As shown in FIG. 6, one pulse of the residual magnetic noise falsely appears a pulse-voltage signal in the ion current detection output for a one-pulse duration Tp.

The system requirement period includes the total duration Ta and the single duration Tb, and is a performance requirement to the ignition coil 1 for detecting the ion current.

When the total duration Ta and the one-pulse duration Tp of the residual magnetic noise become long, the total duration Ta and the one-pulse duration Tp exert bad influence to detection of the ion current. Therefore, the performance requirements are defined by the total duration Ta and the one-pulse duration Tp correlated to the ion current detection performance of the ignition coil 1. In this example, the system requirement period is defined by Ta≦1000 μs and Tp≦416 μs. When the total duration Ta is greater than 1000 μs, or the one-pulse duration Tp is greater than 416 μs, residual magnetic noise may be falsely detected as the ion current, and may cause misevaluation. In this condition, even when misfire occurs, the misfire may not be detected.

Referring to FIG. 3, when the ECU transmits a pulse-shaped spark generating signal to the igniter 223, the power control circuit C1 of the igniter 223 is activated to flow electricity through the primary coil 41. Thus, the magnetic field is formed to pass through the center core 5 and the outer core 6 (FIG. 1). Subsequently, the ECU terminates the electricity supplied to the primary coil 41, so that the center core 5 and the outer core 6 form therebetween an inductive magnetic field opposite to the magnetic field. The inductive magnetic field generates induced electromotive force (counter electromotive force) in the secondary coil 42, so that the sparkplug 35 provided to the ignition coil 1 sparks. The spark ignites mixture of fuel and air, thereby burning the mixture in the combustion chamber 82 in each cylinder of the engine 8.

When the mixture is properly burned in the engine 8, ingredients contained in fuel are ionized. In this condition, the ion current flows between the pair of electrodes 351 of the sparkplug 35. Thus, referring to FIG. 3, the ion current detection circuit C2 detects generation of the ion current.

The ion current detection circuit C2 amplifies the detection signal of the ion current, and transmits the detection signal to the engine ECU. The engine ECU includes a processing circuit and a microcomputer for detecting and monitoring combustion of the engine 8 in accordance with the detection signal transmitted from the ion current detection circuit C2.

In FIG. 4, the generation of the ion current is detected when an ion current detection waveform, which indicates the ion current, upwardly passes beyond an ion current detection reference.

Immediately after forming of the inductive magnetic field to generate spark in the sparkplug 35, residual magnetism remains in the magnetic circuit constructed of the center core 5 and the outer core 6. As shown in FIGS. 4 to 5, when the ion current detection circuit C2 detects the ion current, the engine ECU instructs to wait for a predetermined period before detecting of the ion current, in order to avoid false detection of residual magnetic noise caused by the residual magnetism. This predetermined period is defined by Ta≦1000 μs and Tp≦416 μs as the system requirement period of the engine ECU.

Referring to FIG. 2, the center core upper end surface 51 protrudes from the outer core upper end surface 61 by the stagger distance X with respect to the axial direction L. In the ignition coil 1 of this example, the stagger distance X is defined possibly small to reduce magnetic flux, which outwardly leaks without passing through the center core 5 and the outer core 6. Specifically, the stagger distance X is defined in a range between 3 mm and 12.5 mm. Furthermore, a cross-section ratio B/A (%) between a cross section A of the center core 5 and a cross section B of the outer core 6 is defined in a range between 90% and 120% in the cross section of the ignition coil 1 perpendicular to the axial direction L.

That is, in the ignition coil 1 of this example, the stagger distance X is set possibly small, and the cross-section ratio B/A is appropriately defined. In this structure, the leaking magnetic flux can be restricted from remaining as residual magnetism around the ignition coil 1, immediately after generating spark in the sparkplug 35. Thus, the detection period for residual magnetic noise can be defined within the system requirement period of Ta≦1000 μs and Tp≦416 μs. Thereby, in the ignition coil 1 of this example, detection of the ion current can be protected from influence caused by residual magnetism. Thus, detection accuracy of the ion current can be enhanced.

Figure 7:
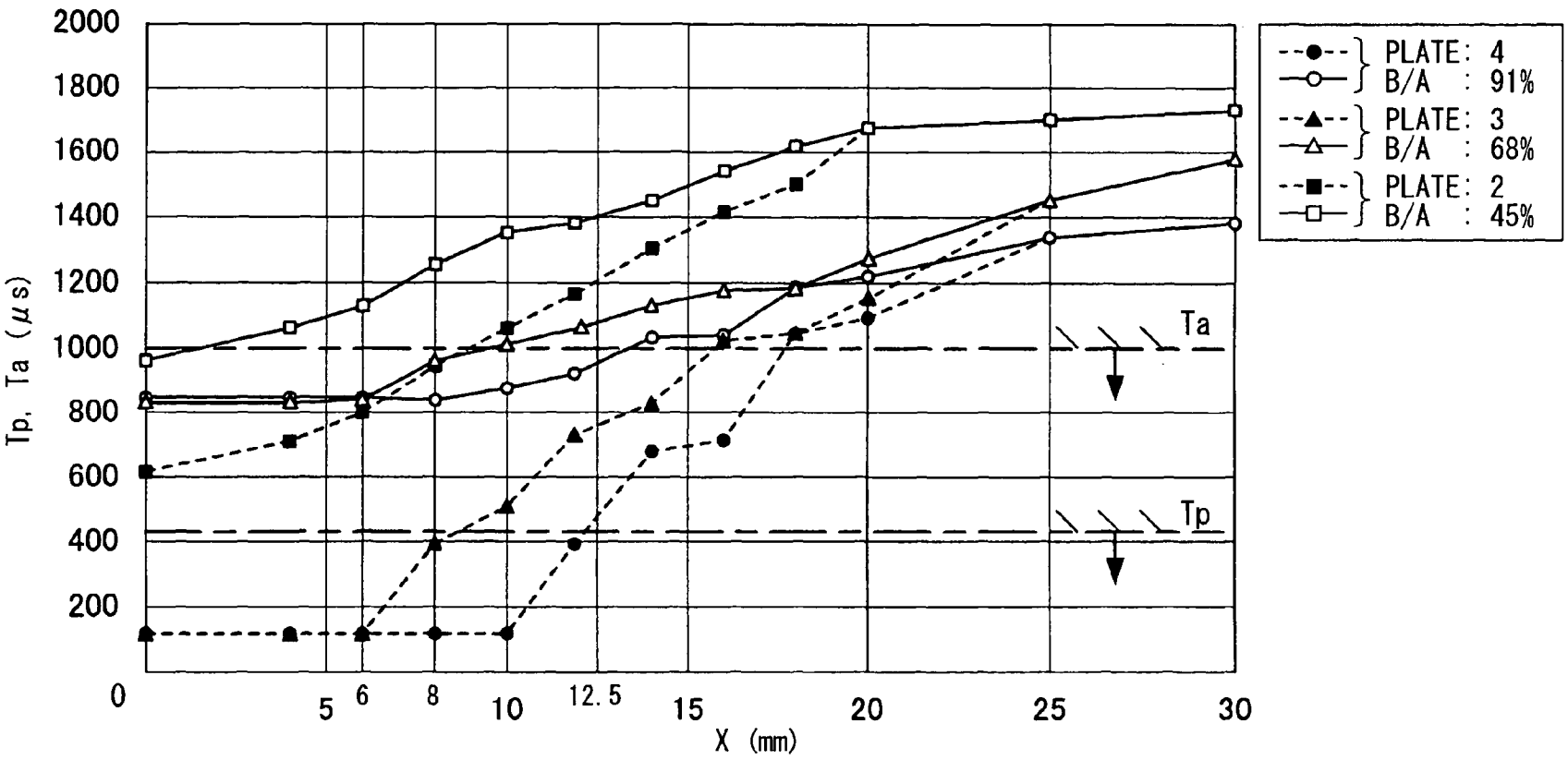
FIG. 7 is a graph showing a relationship of a total duration Ta and a one-pulse duration Tp relative to a stagger distance X, between axial lengths of cores of the ignition coil, obtained in a verification experiment.

As follows, an experiment for verification of the above structure is described. Specifically, in this experiment, a relationship among the stagger distance X, the total duration Ta, and the one-pulse duration Tp of residual magnetic noise is obtained. In this experiment, the number of stacked the electromagnetic steel plates, which construct the outer core 6, is altered for three the cross-section ratios B/A. In FIG. 7, as the stagger distance X becomes large, both the total duration Ta and the one-pulse duration Tp become large.

In a case where the number of the electromagnetic steel plates is four and the cross-section ratio B/A is 91%, the stagger distance X is preferably equal to or less than 12.5 mm to satisfy the condition where Ta≦1000 μs and Tp≦416 μs. In a case where the number of the electromagnetic steel plates is three and the cross-section ratio B/A is 68%, the stagger distance X is preferably equal to or less than 8 mm to satisfy the condition where Ta≦1000 μs and Tp≦416 μs. In a case where the number of the electromagnetic steel plates is four and the cross-section ratio B/A is 91%, and the stagger distance X is greater than 10 mm, the one-pulse duration Tp (waveform distortion) becomes large. In a case where the number of the electromagnetic steel plates is three and the cross-section ratio B/A is 68%, and the stagger distance X is greater than 6 mm, the one-pulse duration Tp (waveform distortion) also becomes large.

Figure 8:
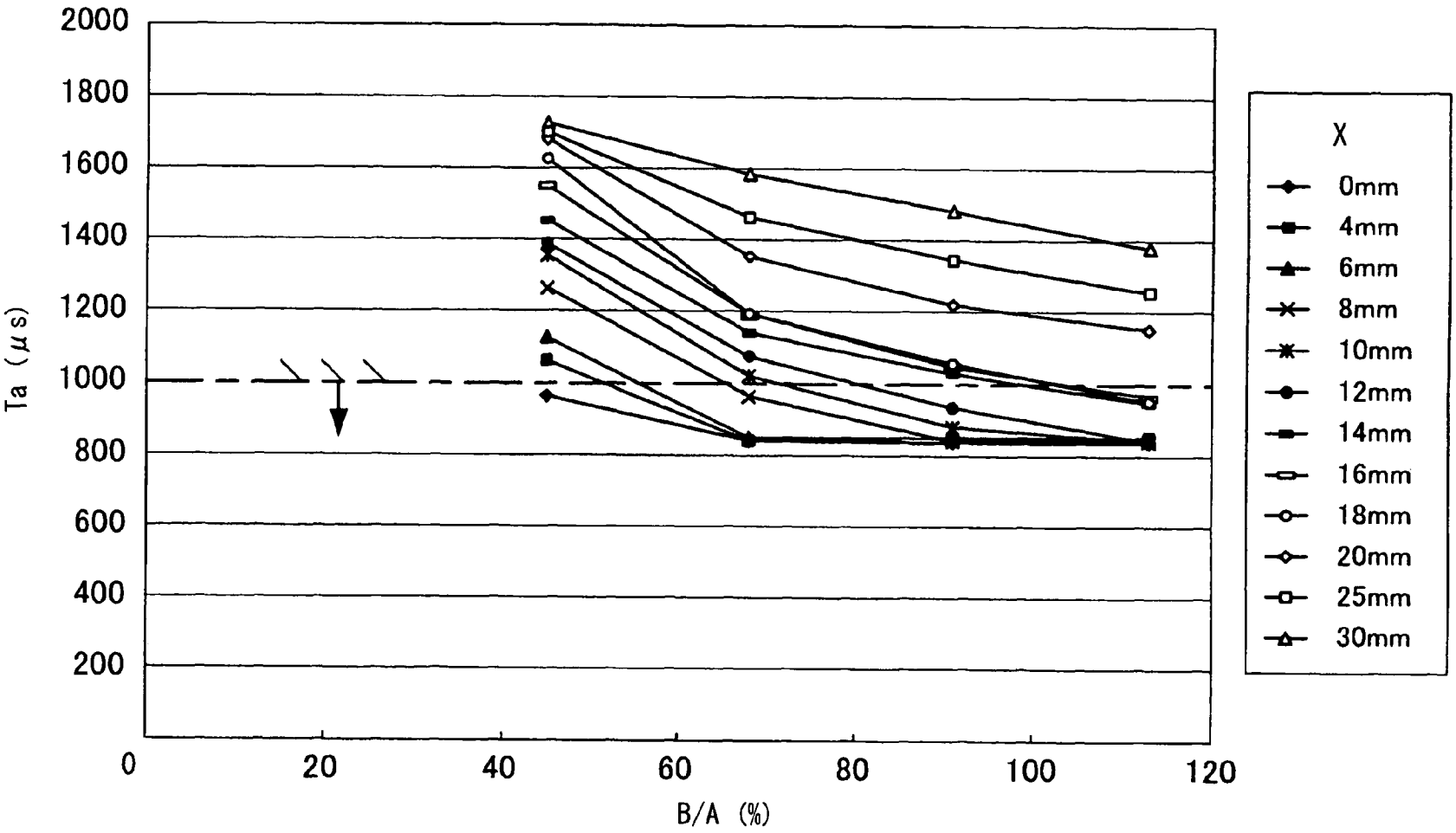
FIG. 8 is a graph showing a relationship between a cross-section ratio B/A and the total duration Ta, obtained in the verification experiment.
Figure 9:
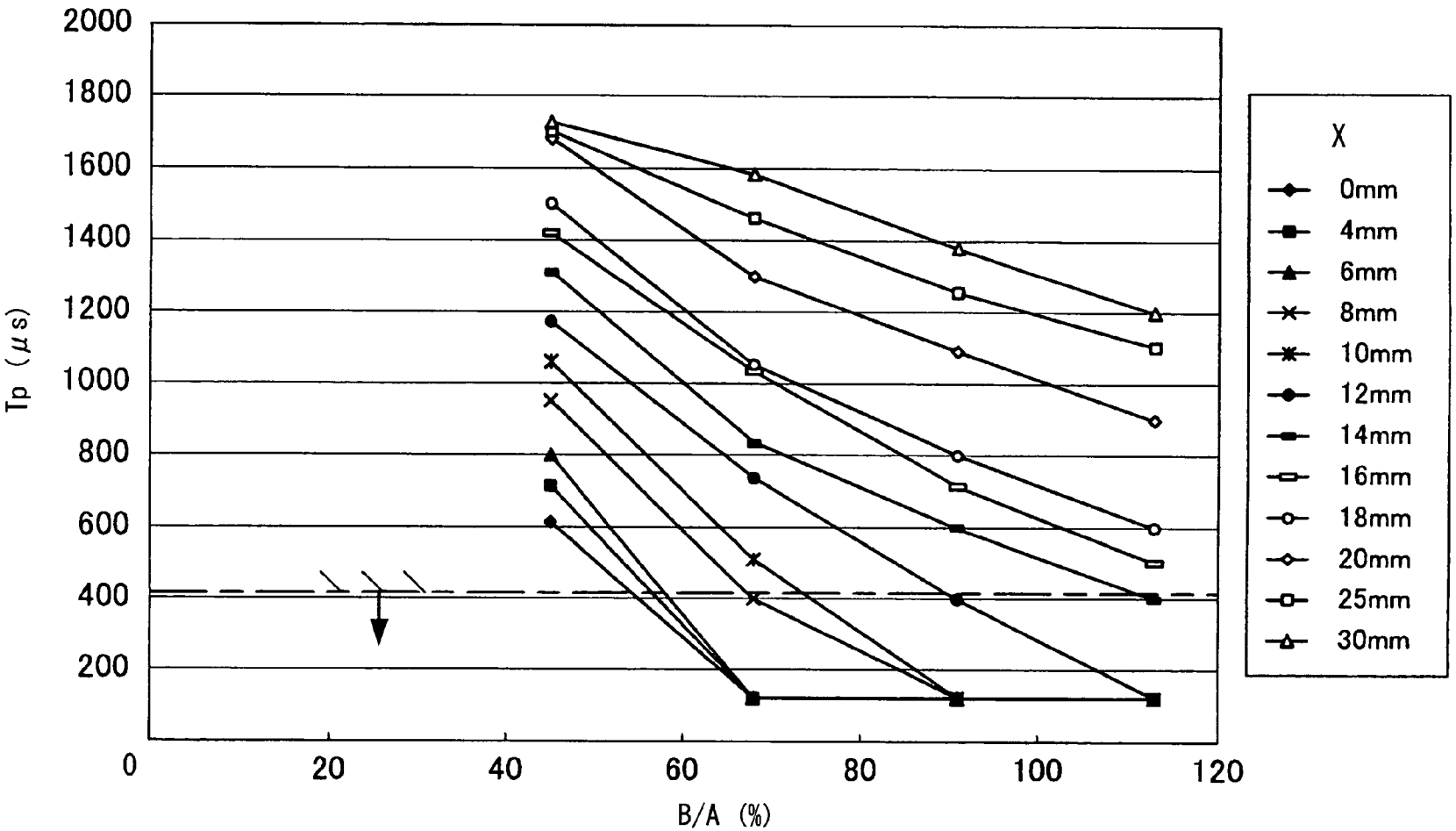
FIG. 9 is a graph showing a relationship between the cross-section ratio B/A and the one-pulse duration Tp, obtained in the verification experiment.

As shown in FIGS. 8, 9, as the stagger distance X becomes large, the total duration Ta and the one-pulse duration Tp become large. By contrast, as the cross-section ratio B/A becomes large, the total duration Ta and the one-pulse duration Tp become small.

Figure 10:
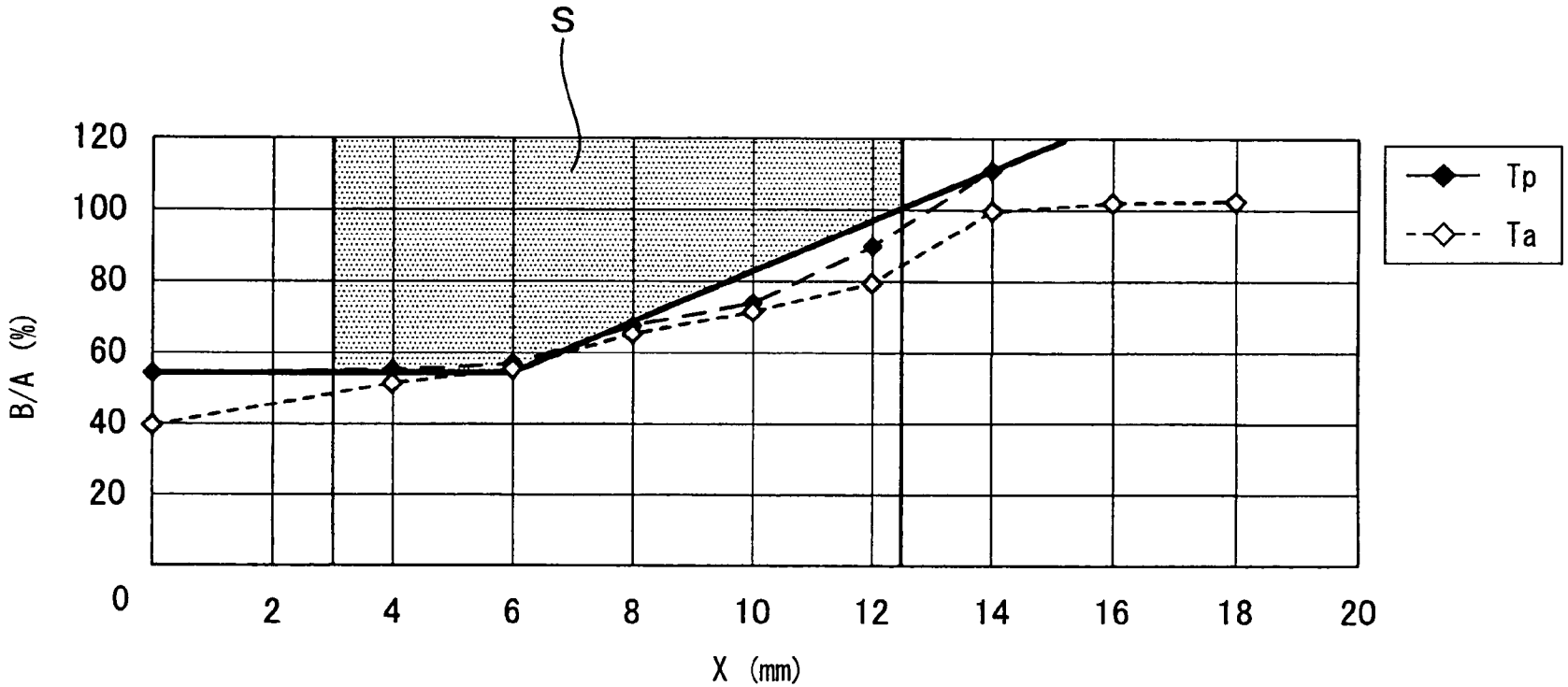
FIG. 10 is a graph showing a relationship between the stagger distance X and the cross-section ratio B/A, obtained in the verification experiment.

In this experiment, the cross-section ratio B/A is obtained with respect to each stagger distance X in a condition where the total duration Ta is 1000 μs. In addition, the cross-section ratio B/A is also obtained with respect to each stagger distance X in a condition where the one-pulse duration Tp is 416 μs. Thus, the relationship between the stagger distance X and the cross-section ratio B/A is obtained. As shown in FIG. 10, as the stagger distance X becomes large, the cross-section ratio B/A is increased, so that the detection period for residual magnetic noise can be defined within the system requirement period of Ta≦1000 μs and Tp≦416 μs.

Thus, the relationship between the stagger distance X and the cross-section ratio B/A can be defined within a proper region S in FIG. 10, by increasing the cross-section ratio B/A adaptively to increase in stagger distance X.

As follows, the relationship between the stagger distance X and the cross-section ratio B/A is linearized, so that the following equation is obtained to define the relationship satisfying the system requirement period. The one-pulse duration Tp is strict, i.e., effective to the system requirement period, compared with the total duration Ta. Therefore, this relationship is obtained on the basis of the one-pulse duration Tp. In this relationship, when the stagger distance X is equal to or less than 6 mm, the cross-section ratio B/A is set to be equal to or greater than 54.3. When the stagger distance X is greater than 6 mm, the cross-section ratio B/A is set to be equal to or greater than $7.11\times(X-6)+54.3$. Thus, the relationship satisfies the system requirement period.

In the structure of the ignition coil 1, it is difficult to set the stagger distance X to be less than 3 m. By contrast, when the stagger distance X is greater than 12.5 mm, It is difficult to maintain the one-pulse duration Tp to be small. Therefore, when the stagger distance X is equal to or greater than 3 mm and equal to or less than 6 mm, the cross-section ratio B/A is preferably set to be equal to or greater than 54.3, i.e., B/A≧54.3. In addition, when the stagger distance X is greater than 6 mm and equal to or less than 12.5 mm, the cross-section ratio B/A is set to be equal to or greater than $7.11\times(X-6)+54.3$, i.e., $B/A\geqq 7.11\times(X-6)+54.3$.

Preferably, the cross-section ratio B/A is set possibly large, in order to possibly reduce the total duration Ta and the one-pulse duration Tp. Practically, the cross-section ratio B/A is set to be equal to or greater than 90%. When the cross-section ratio B/A is set excessively large, the thickness of the outer core 6 becomes large, and the outer diameter of the ignition coil 1 becomes large. Therefore, the cross-section ratio B/A is preferably set to be equal to or less than 120%.

The above controls and processings such as calculations and determinations are not limited being executed by the ECU and the engine ECU described in the above embodiment. The control system may have various structures including a control unit such as the ECU, the engine ECU, and combination thereof.

Various modifications and alternations may be diversely made to the above embodiments without departing from the spirit of the present invention.

What is claimed is:

1. An ignition coil for a sparkplug having electrodes, the ignition coil adapted to being electrically connected with a control unit, the ignition coil comprising:

primary and secondary coils each having an axial high voltage end adapted to connecting with the sparkplug;

an ion current detector for detecting an ion current flowing through the electrodes;

a center core provided on a radially inner side of the primary and secondary coils, the center core being formed of a magnetic material; and an outer core provided on a radially outer side of the primary and secondary coils, the outer core being formed of a magnetic material;

wherein the center core has an axial low voltage end defining a center low end surface, the outer core has an axial low voltage end defining an outer low end surface, the center low end surface axially protrudes toward an opposite side of the axial high voltage end relative to the outer low end surface, the center low end surface is located at a stagger distance from the outer low end surface with respect to an axial direction of the center core, and the stagger distance is defined such that a detection period correlated to residual magnetic noise in the ion current detection output of the ion current detector is within a system requirement period of the control unit, wherein the stagger distance is equal to or greater than 3 mm, and the stagger distance is equal to or less than 12.5 mm.

2. The ignition coil according to claim 1, wherein the stagger distance is equal to or greater than 3 mm, and the stagger distance is equal to or less than 8 mm.

3. The ignition coil according to claim 1, wherein the center core has a center-core cross section perpendicularly to an axial direction of the center core, the outer core has an outer-core cross section perpendicularly to an axial direction of the outer core, the center-core cross section and the outer-core cross section are in an outer-to-center cross-section ratio, wherein the outer-to-center cross-section ratio is equal to or greater than 90%, and the outer-to-center cross-section ratio is equal to or less than 120%.

4. The ignition coil according to claim 1, wherein the residual magnetic noise is indicated by a plurality of waves in the ion current detection output, and the stagger distance is defined such that a duration period of at least one of the plurality of waves is within the system requirement period of the control unit.

5. The ignition coil according to claim 1, wherein the center core and the outer core generate residual magnetism after forming of an inductive magnetic field to generate spark in the sparkplug, the residual magnetism indicates a plurality of waves defining the residual magnetic noise in the ion current detection output, before the ion current detector detects an ion current detection waveform indicating the ion current, the plurality of waves has a total period of a total duration, each of the plurality of waves has a period of a one-pulse duration, and the stagger distance is defined such that both the total duration and the one-pulse duration are respectively within system requirement periods of the control unit.

6. The ignition coil according to claim 5, wherein the control unit waits for a predetermined period before obtaining an ion current detection waveform indicating the ion current to restrict false detection of the residual magnetism, and the predetermined period is correlated to the system requirement period.

7. The ignition coil according to claim 1, wherein the center core and the outer core generate residual magnetism after forming of an inductive magnetic field to generate spark in the sparkplug, the residual magnetism indicates a plurality of waves in the ion current detection output, before the ion current detector detects an ion current detection waveform indicating the ion current, the plurality of waves has a total period of a total duration, and the control unit waits for at least the total duration before obtaining an ion current detection waveform indicating the ion current.

8. The ignition coil according to claim 5, wherein the total duration is equal to or less than 1000 μs, and the one-pulse duration is equal to or less than 416 μs.

9. An ignition coil for a sparkplug having electrodes, the ignition coil comprising:

primary and secondary coils each having an axial high voltage end connectable with the sparkplug;

an ion current detector for detecting an ion current flowing through the electrodes;

a center core provided on a radially inner side of the primary and secondary coils, the center core being formed of a magnetic material; and an outer core provided on a radially outer side of the primary and secondary coils, the outer core being formed of a magnetic material, wherein the center core has an axial low voltage end defining a center low end surface, the outer core has an axial low voltage end defining an outer low end surface, the center low end surface axially protrudes toward an opposite side of the axial high voltage end relative to the outer low end surface, the center low end surface is located at a stagger distance from the outer low end surface with respect to an axial direction, the stagger distance is equal to or greater than 3 mm, and is equal to or less than 12.5 mm, wherein the center core has a center-core cross section perpendicularly to the axial direction, the outer core has an outer-core cross section perpendicularly to the axial direction, the center-core cross section and the outer-core cross section are in an outer-to-center cross-section ratio, the outer-to-center cross-section ratio is equal to or greater than 54.3, in a structure in which the stagger distance is equal to or greater than 3 mm and equal to or less than 6 mm, and the outer-to-center cross-section ratio is equal to or greater than 7.11×(stagger distance−6)+54.3, in a structure in which the stagger distance is greater than 6 mm and equal to or less than 12.5 mm.

10. An ignition coil system for a sparkplug having electrodes, the ignition coil system comprising:

a control unit; and an ignition coil electrically connected with the control unit, wherein the ignition coil includes:

primary and secondary coils each having an axial high voltage end adapted to connecting with the sparkplug;

an ion current detector for detecting an ion current flowing through the electrodes and transmitting an ion current detection output;

a center core provided on a radially inner side of the primary and secondary coils, the center core being formed of a magnetic material; and an outer core provided on a radially outer side of the primary and secondary coils, the outer core being formed of a magnetic material, wherein the center core has an axial low voltage end defining a center low end surface, the outer core has an axial low voltage end defining an outer low end surface, the center low end surface axially protrudes toward an opposite side of the axial high voltage end relative to the outer low end surface, the center low end surface is located at a stagger distance from the outer low end surface with respect to an axial direction of the center core, and the stagger distance is defined such that a duration period of at least one of a plurality of waves indicating residual magnetic noise in the ion current detection output is within a system requirement period of the control unit, wherein the stagger distance is equal to or greater than 3 mm, and the stagger distance is equal to or less than 12.5 mm.

11. The ignition coil according to claim 10, wherein the stagger distance is equal to or greater than 3 mm, and the stagger distance is equal to or less than 8 mm.

12. The ignition coil according to claim 10, wherein the center core has a center-core cross section perpendicularly to an axial direction of the center core, the outer core has an outer-core cross section perpendicularly to an axial direction of the outer core, the center-core cross section and the outer-core cross section are in an outer-to-center cross-section ratio, wherein the outer-to-center cross-section ratio is equal to or greater than 90%, and the outer-to-center cross-section ratio is equal to or less than 120%.

13. The ignition coil system according to claim 10, wherein the center core and the outer core generate residual magnetism after forming of an inductive magnetic field to generate spark in the sparkplug, the residual magnetism indicates the plurality of waves defining the residual magnetic noise in the ion current detection output, before the ion current detector detects an ion current detection waveform indicating the ion current, the plurality of waves has a total period of a total duration, each of the plurality of waves has a period of a one-pulse duration, and the stagger distance is defined such that both the total duration and the one-pulse duration are respectively within system requirement periods of the control unit.

14. The ignition coil system according to claim 13, wherein the control unit waits for a predetermined period before obtaining an ion current detection waveform indicating the ion current to restrict false detection of the residual magnetism, and the predetermined period is correlated to the system requirement period.

15. The ignition coil system according to claim 10, wherein the center core and the outer core generate residual magnetism after forming of an inductive magnetic field to generate spark in the sparkplug, the residual magnetism indicates a plurality of waves in the ion current detection output, before the ion current detector detects an ion current detection waveform indicating the ion current, the plurality of waves has a total period of a total duration, and the control unit waits for at least the total duration before obtaining an ion current detection waveform indicating the ion current.

16. The ignition coil system according to claim 13, wherein the total duration is equal to or less than 1000 μs, and the one-pulse duration is equal to or less than 416 μs.

* * * * *